US011925249B2

(12) United States Patent
Ficcadenti et al.

(10) Patent No.: US 11,925,249 B2
(45) Date of Patent: Mar. 12, 2024

(54) CONTAINER FOR A PRODUCT IN THE FORM OF A LIQUID OR A GEL, IN PARTICULAR FOR A COSMETIC PRODUCT

(71) Applicant: BARALAN INTERNATIONAL S.P.A., Trezzano Sul Naviglio (IT)

(72) Inventors: Maurizio Ficcadenti, Milan (IT); Roland Baranes, Milan (IT)

(73) Assignee: BARALAN INTERNATIONAL S.P.A., Trezzano Sul Naviglio (IT)

( * ) Notice: Subject to any disclaimer, the term of this patent is extended or adjusted under 35 U.S.C. 154(b) by 0 days.

(21) Appl. No.: 18/040,124

(22) PCT Filed: Jul. 22, 2021

(86) PCT No.: PCT/IB2021/056635

§ 371 (c)(1),
(2) Date: Jan. 31, 2023

(87) PCT Pub. No.: WO2022/023898

PCT Pub. Date: Feb. 3, 2022

(65) Prior Publication Data

US 2023/0270233 A1 Aug. 31, 2023

(30) Foreign Application Priority Data

Jul. 31, 2020 (IT) ..... 102020000018706

(51) Int. Cl.
*A45D 34/04* (2006.01)
*A45D 40/26* (2006.01)

(52) U.S. Cl.
CPC ..... *A45D 34/045* (2013.01); *A45D 40/265* (2013.01)

(58) Field of Classification Search
CPC .... A45D 34/04; A45D 34/042; A45D 34/043; A45D 34/045; A45D 34/046;
(Continued)

(56) References Cited

U.S. PATENT DOCUMENTS 668,053 A * 2/1901 Scattergood ..... A45D 40/265 401/15
2,341,102 A 2/1944 Kanzaki
4,733,788 A * 3/1988 D'Amico ..... A45D 40/265 401/121

FOREIGN PATENT DOCUMENTS

EP 1444917 A1 8/2004
FR 2989255 A1 10/2013

OTHER PUBLICATIONS

International Search Report and Written Opinion for PCT/IB2021/056635 (dated Oct. 29, 2021).

* cited by examiner

*Primary Examiner* — David J Walczak
(74) *Attorney, Agent, or Firm* — Merchant & Gould P.C.

(57) ABSTRACT

A container includes a receptacle having a main portion in which a cavity is defined for containing a liquid or gel product, and a neck extending from the main portion and having an upper aperture which opens into the cavity. A closure element can be removably coupled with the receptacle to close the cavity at the aperture. An annular body can be fixed to the receptacle in such a way as to encircle the neck. When the annular body and the receptacle are mutually fixed, a gap is defined between the annular body and the neck which is configured to collect part of the product, such as product dropped from the brush, to be contained within the cavity and/or protruding through the aperture of the neck, thereby allowing the user to avoid getting dirty.

7 Claims, 4 Drawing Sheets

(58) Field of Classification Search
CPC .... A45D 40/26; A45D 40/262; A45D 40/264;
A45D 40/265; A45D 40/267
USPC ..... 401/15, 126–130
See application file for complete search history.

CONTAINER FOR A PRODUCT IN THE FORM OF A LIQUID OR A GEL, IN PARTICULAR FOR A COSMETIC PRODUCT

This application is a National Stage Application of International Application No. PCT/IB2021/056635, filed Jul. 22, 2021, which claims benefit of Ser. No. 102020000018706, filed Jul. 31, 2020, in Italy and which applications are incorporated herein by reference. To the extent appropriate, a claim of priority is made to each of the above-disclosed applications.

TECHNICAL FIELD

The present invention refers to a container for a product in the form of a liquid or a gel, in particular for a cosmetic product.

TECHNICAL BACKGROUND

Containers for products in liquid or gel form are known in the art, in particular for cosmetic products. Such containers generally comprising a receptacle and a closure element. The receptacle comprises a main portion in which a cavity is defined for containing a liquid or gel product. Moreover, the receptacle also comprises a neck extending from the main portion and having an upper aperture which opens into the cavity. In turn, the closure element can be removably coupled to the receptacle in such a way as to close said cavity at the aperture. Moreover, the closure element comprises an applicator assembly configured to pass through said aperture and access the cavity, in such a way as to collect said product and be able to distribute it outside the receptacle.

However, all the containers known in the art suffer from some drawbacks which it is desirable to overcome.

SUMMARY OF THE INVENTION

An object of the present invention is to provide a container for a product in liquid or gel form, in particular for a cosmetic product, which is able to solve the drawbacks of the prior art.

According to the present invention, this and other objects are achieved by means of a container having the technical features mentioned in the appended independent claim.

It should be understood that the appended claims form an integral part of the technical teachings herein provided in the following detailed description relating to the present invention. In particular, some preferred embodiments of the present invention including optional technical features are defined in the appended dependent claims.

Further features and advantages of the present invention will become apparent from the detailed description below, given purely by way of non-limiting example, with particular reference to the accompanying drawings summarised below.

Figure 1:
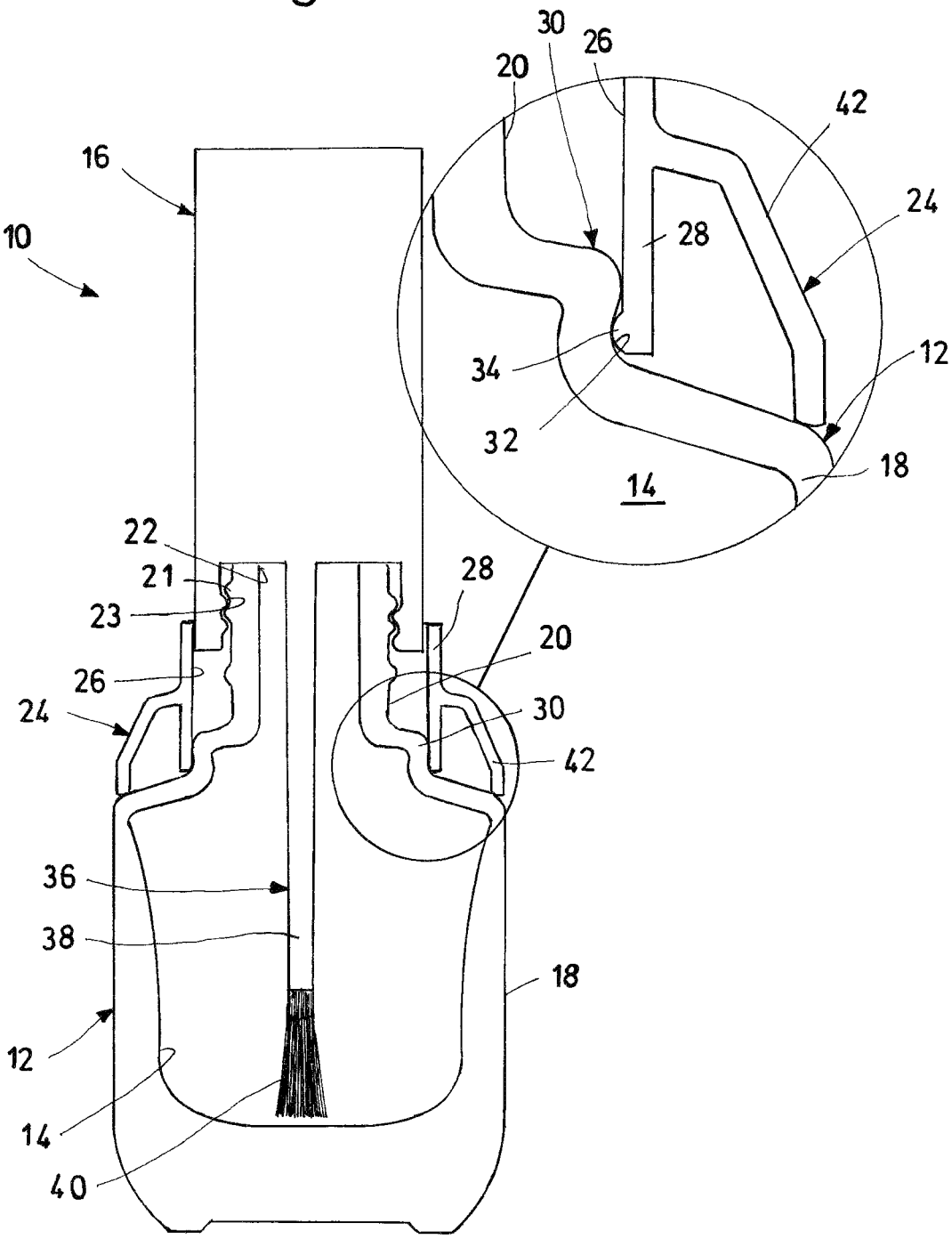
FIG. 1 is an axial or longitudinal sectional view of a container provided according to an exemplary embodiment of the present invention. In the above figure, an enlargement of some embodiment details of the container is shown and is surrounded by a dotted circular line.

For the sake of completeness, the following is a list of the alphanumeric references used to identify parts, elements and components illustrated in the drawings summarised above.

10. Container
12. Receptacle
14. Cavity
16. Closure element
18. Main portion
20. Neck
21. Outer thread
22. Aperture
23. Inner thread
24. Annular body
26. Gap
28. Tubular portion
30. Intermediate portion
32. Groove
34. Inner projection
36. Applicator assembly
38. Rod
40. Brush
42. Outer covering
44. Lower notches
46. Hooking portions

DETAILED DESCRIPTION OF THE INVENTION

With reference to FIG. 1, an axial or longitudinal sectional view of a container 10 for a product in a liquid or gel form, in particular for a cosmetic product, is shown. Container 10 is provided according to an exemplary embodiment of the present invention.

As will be described below, the use of container 10 is particularly advantageous for containing products, such as nail varnish or gels made of materials intended to solidify by exposure to UV rays. Indeed, in case of leakage, such materials tend to continue to dirty due to non-drying, since they do not dry and do not normally solidify in the air, but only in case of a UV exposure that naturally occurs very slowly. As is clear to a person skilled in the art, such container 10 can also be used conveniently for any other type of product; for example, it can be used to also contain types of enamels or gels other than those mentioned above, because it would protect the person applying the product against soiling for the whole time required for drying the leaked product.

Container 10 comprises a receptacle 12 defining within it a cavity 14 configured to contain a liquid or gel substance. In the illustrated embodiment, receptacle 12 is made of a transparent material, for example glass.

Moreover, container 10 comprises a closure element 16 configured to removably close cavity 14. In the illustrated embodiment, closure element 16 is made of plastic material.

In FIG. 1, container 10 is shown in a coupled condition between receptacle 12 and closure element 16. In this condition, closure element 16 closes cavity 14 in a substantially air-tight manner, in such a way as to preserve the properties and features of the product intended to be contained therein.

Receptacle 12 comprises a main portion 18 in which cavity 14 is defined and a neck 20 extending from main portion 18. Neck 20 has an upper aperture 22 which opens into cavity 14 and is configured to allow the passage of the product, so that cavity 14 can be filled and in such a way as to allow the subsequent withdrawal of the product from receptacle 12.

Closure element 16 can be removably coupled with said receptacle 12 so as to close said cavity 14 at said aperture 22. In particular, closure element 16 can be removably coupled at neck 20 of receptacle 12, for example by screwing around it. In the illustrated embodiment, neck 20 has an external thread 21 and the closure element has an internal thread 23 configured to couple with external thread 21, so as to ensure removable coupling between neck 20 and closure element 16.

Closure element 16 includes an applicator assembly 36 configured to pass through aperture 22 and access cavity 14. In particular, applicator 36 is configured in such a way as to be able to collect the product intended to be contained in cavity 14 and distribute it outside. For example, applicator assembly 36 comprises a rod 38 extending substantially centrally and a brush 40 located at the end of rod 38 and configured to collect a quantity of the product intended to be contained in cavity 14.

Container 10 further comprises an annular body 24 which can be fixed to receptacle 12 in such a way as to encircle neck 20. When annular body 24 and receptacle 12 are mutually fixed, a gap 26 is defined between annular body 24 and neck 20 and is configured to collect part of the product that can leak out of receptacle 12.

Figure 5:
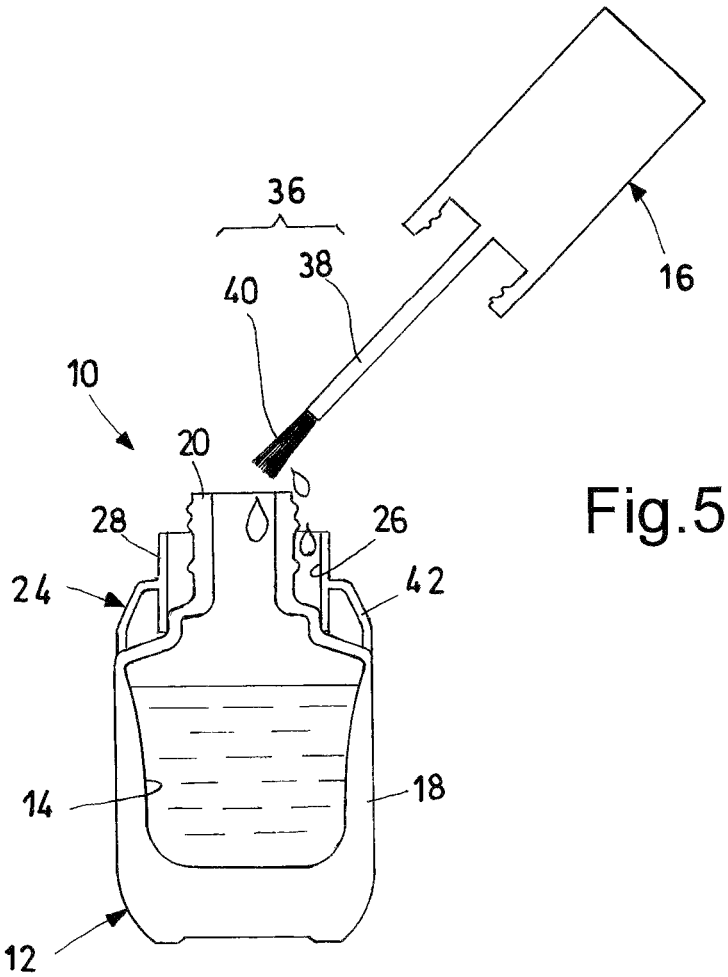
FIG. 5 is an axial or longitudinal sectional view of the container shown in the preceding figures, in which the applicator-equipped closure element is removed from the receptacle.

As can be seen in FIG. 5, when applicator assembly 36 is removed, in case of leakage and undesired fall of liquid towards receptacle 12, annular body 24 is able to collect such liquid in gap 26.

As is clear to a person skilled in the art, for fixing annular body 24 and the receptacle 12, in particular around its neck 20, a hermetic seal between them is not essential. Indeed, the quantity of product that generally leaks out of receptacle 12 and/or flows from applicator assembly 36 is minimal and is therefore not generally able to flow beyond the contact boundary between annular body 24 and receptacle 12.

In the illustrated embodiment, annular body 24 is made as a separate piece with respect to receptacle 12, since the glass moulding technology does not generally allow to obtain the containment form made by annular body 24 directly on neck 20 of a receptacle 12, in particular when made of glass.

Preferably, annular body 24 can be removably coupled with receptacle 12. For example, as will be described in more detail below with reference to optional technical features, annular body 24 can be coupled with receptacle 12 through snap coupling means.

Figure 3:
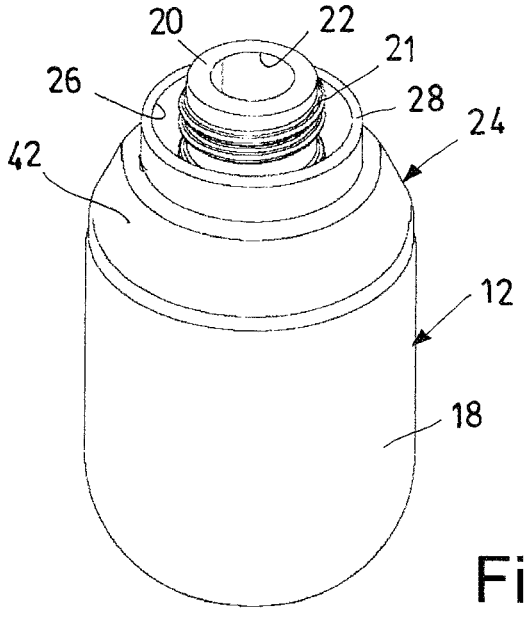
FIGS. 2 and 3 are two partial views, one in perspective and the other one in side elevation, of the container of FIG. 1, in which the closure element is omitted.
Figure 2:
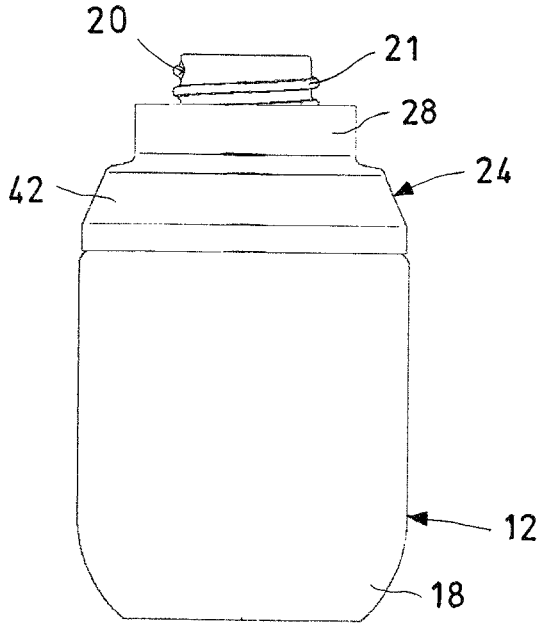
Figure 4:
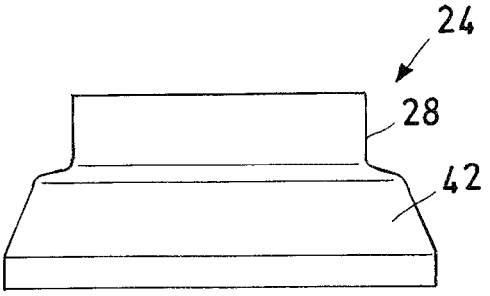
FIG. 4 is a side elevation view of an annular body of the container shown in the preceding figures.

In the illustrated embodiment, for example in FIGS. 2 to 4, annular body 24 comprises a tubular portion 28 configured to define gap 26 with neck 20.

In particular, receptacle 12 comprises an intermediate portion 30 located axially between main portion 18 and neck 20 and configured to couple with annular body 24. In the illustrated embodiment, the cross-section of intermediate portion 30 is greater than that of neck 20 and respectively smaller than that of main portion 18. In particular, as viewed in axial section, intermediate portion 30 provides a "step-like" shape interposed between main portion 18 and neck 20.

Preferably, intermediate portion 30 couples with tubular portion 28 of annular body 24. For example, intermediate portion 30 is provided with a groove 32 located externally, and tubular portion 28 is provided with an projection 34 located internally and couplable with groove 32. In particular, groove 32 and inner projection 34 extend perimetrically with respect to intermediate portion 30 and, respectively, to tubular portion 28. In further alternative embodiments (not shown), as is evident to a person skilled in the art, it is possible to exchange the arrangement between the groove and the inner projection, in particular by providing an inner groove on the tubular portion of the annular body and an outer projection on the intermediate portion of the receptacle. As is clear to a person skilled in the art, in still further alternative embodiments, the coupling between annular portion 28 and intermediate portion 30 can occur in a different way with respect to the hooking described above.

In the illustrated embodiment, as mentioned above, outer groove 32 and inner projection 34 contribute to advantageously providing a coupling of the removable type, in particular of the snap type.

Annular body 24 also has an outer covering 42 which extends laterally from tubular portion 28 and overlaps main portion 18 of receptacle 12. In particular, outer covering 42 develops from an axially intermediate region of annular body 24. Advantageously, covering 42 has a shape connectable to the shape of receptacle 12, in particular to give continuity to the shape shown overall by container 10.

In the illustrated embodiment, outer covering 42 extends perimetrically from tubular portion 28 in such a way as to cover the upper part of the main portion of receptacle 12.

In particular, outer covering 42 widens laterally downwards, for example, with a substantially truncated cone shape development.

Figure 6:
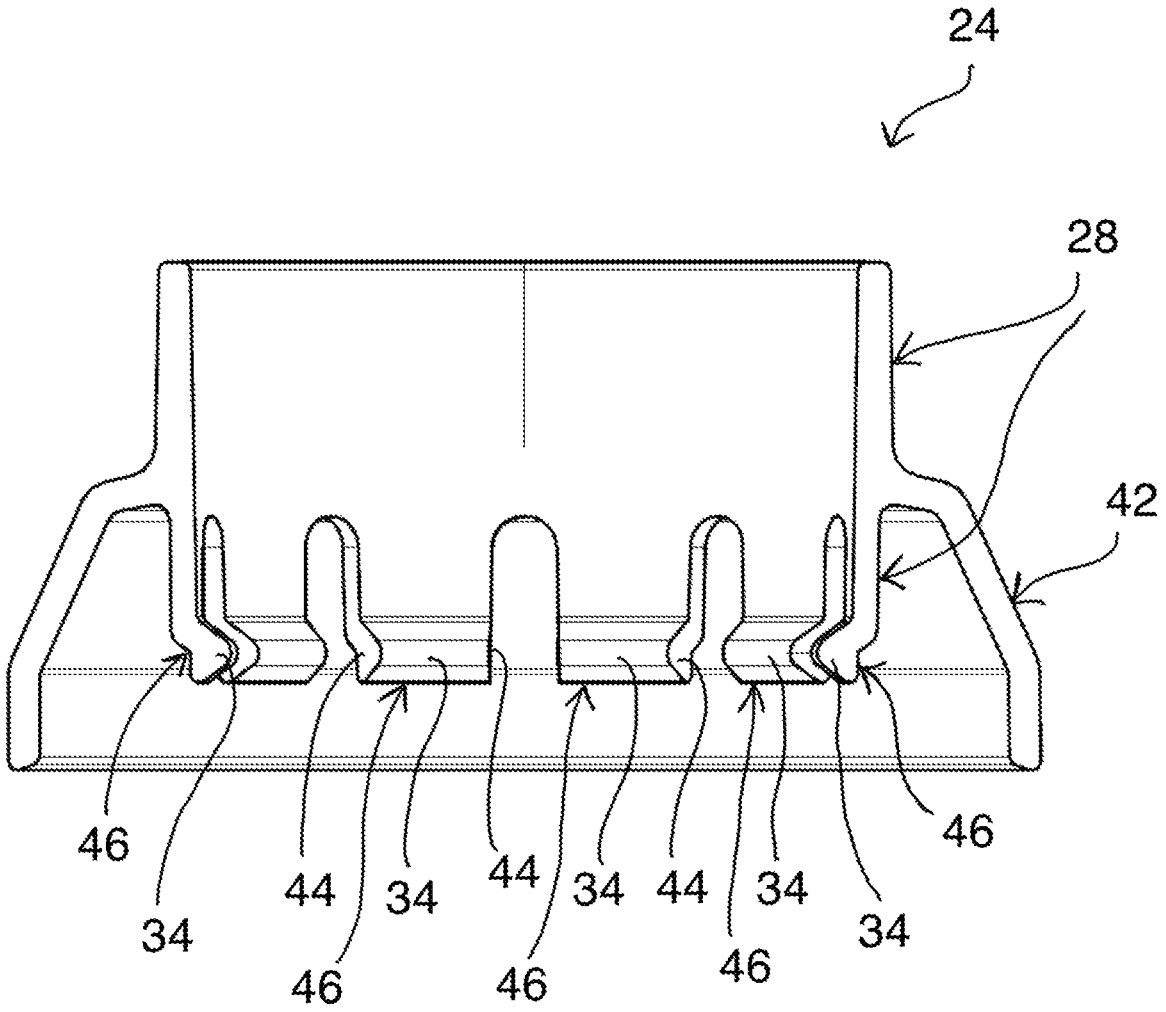
FIG. 6 is an axial section of an alternative embodiment of the only annular body of the container shown in the preceding figures.

With reference to FIG. 6, an alternative embodiment of annular body 24 of the container shown in the previous figures is illustrated. In this alternative embodiment, in annular body 24, the bottom edge of tubular portion 28 has a plurality of lower notches 44 which extend perimetrically. These lower notches 44 divide the bottom of the annular portion into a plurality of elastically flexible hooking portions 46. Each of hooking portions 46 is provided with a respective inner projection 34 able to couple with groove 32. In this way, a snap connection of an improved type is provided which does not require the use of other means or elements (for example, glues or the like) to ensure a connection between receptacle 12 and annular body 24.

Naturally, without prejudice to the principle of the invention, the embodiments and implementation details may be widely varied with respect to what is described and illustrated purely by way of non-limiting example, without thereby departing from the scope of the invention as defined in the appended claims.

The invention claimed is:

1. A container for a product in a liquid or a gel form, for a cosmetic product; said container comprising:

a receptacle comprising:

a main portion in which a cavity is defined for containing a liquid or gel product, and a neck extending from the main portion and having an upper aperture which opens into said cavity;

a closure element removably coupled with said receptacle to close said cavity at said aperture; said closure element comprising an applicator assembly configured to pass through said aperture and access the cavity to collect said product and be able to distribute said product outside; and an annular body fixable to said receptacle to encircle said neck;

wherein, when said annular body and said receptacle are mutually fixed, a gap is defined between said annular body and said neck which is configured to collect part of the product to be contained within said cavity and/or leaking through said aperture of said neck;

wherein said annular body comprises a tubular portion configured to define said gap with the neck when said annular body is coupled with said receptacle; wherein said annular body further comprises an outer covering extending laterally from said tubular portion and overlapping the main portion of the receptacle; and wherein said outer covering develops from an axially intermediate region of said annular body.

2. The container according to claim 1, wherein said annular body is removably couplable with said receptacle.

3. The container according to claim 2, wherein said annular body is couplable with said receptacle by a snap coupling.

4. The container according to claim 1, wherein said receptacle comprises an intermediate portion axially located between said main portion and said neck and configured to be coupled with said annular body.

5. The container according to claim 4, wherein the intermediate portion couples with the tubular portion of the annular body.

6. The container according to claim 5, wherein one of said intermediate portion and said tubular portion is provided with a groove, and the other one of said intermediate portion and said tubular portion is provided with a projection which is couplable with said groove.

7. The container according to claim 1, wherein said outer covering perimetrically extends from said tubular portion to cover an upper part of said main portion of said receptacle.

* * * * *